US006850170B2

(12) United States Patent
Neff

(10) Patent No.: US 6,850,170 B2
(45) Date of Patent: Feb. 1, 2005

(54) ON-BOARD VEHICLE SYSTEM AND METHOD FOR RECEIVING AND INDICATING DRIVING-RELATED SIGNALS

(76) Inventor: Ryan A. Neff, 4 Eugene Cir., Lincoln Park, NJ (US) 07035

( * ) Notice: Subject to any disclaimer, the term of this patent is extended or adjusted under 35 U.S.C. 154(b) by 180 days.

(21) Appl. No.: 10/107,006

(22) Filed: Mar. 25, 2002

(65) Prior Publication Data

US 2003/0179106 A1 Sep. 25, 2003

(51) Int. Cl.[7] ..... G08G 1/095

(52) U.S. Cl. ..... 340/907; 340/901; 340/902; 340/903; 340/905; 340/539.1; 180/271

(58) Field of Search ..... 340/907, 901, 340/902, 903, 904, 905, 909, 936, 441, 438, 929, 539.1; 180/170, 271, 275, 171

(56) References Cited

U.S. PATENT DOCUMENTS

| | | | | | |
|---|---|---|---|---|---|
| 2,442,851 | A | * | 6/1948 | Halstead | 340/905 |
| 3,656,099 | A | * | 4/1972 | Campbell | 340/901 |
| 3,899,671 | A | * | 8/1975 | Stover | 455/524 |
| 5,635,920 | A | * | 6/1997 | Pogue et al. | 340/901 |
| 5,940,010 | A | * | 8/1999 | Sasaki et al. | 340/901 |

* cited by examiner

*Primary Examiner*—Donnie L. Crosland

(57) ABSTRACT

Disclosed herein is a system for use on board a vehicle for receiving and indicating driving related signals, including the phases of traffic light signals to a driver of the vehicle. The system includes a receiver which responds to a plurality of driving-related signals including at least one transmitted signal representing a phase of a traffic light signal in proximity to the system. The system further includes one or more signal indicators coupled to the receiver output which indicate signals to a driver.

13 Claims, 2 Drawing Sheets

ON-BOARD VEHICLE SYSTEM AND METHOD FOR RECEIVING AND INDICATING DRIVING-RELATED SIGNALS

FIELD OF THE INVENTION

The invention relates to transportation safety systems, and more specifically to a system on board a vehicle for receiving and displaying driving-related signals such as traffic light signals.

BACKGROUND OF THE INVENTION

Conventional traffic light signaling at intersections only works well under good weather conditions. When sunglare or heavy precipitation are present, it can be difficult to understand whether a given traffic signal glows red, green or amber. Often under such conditions a driver will finally identify the traffic signal later than he or she should, with little time left to stop the vehicle when the signal glows red. During twilight periods, when eyes have difficulty distinguishing objects in the partially illuminated landscape, it can be just as difficult to understand when an intersection is being approached, and to watch for the presence of a traffic signal. In addition to these problems which affect all drivers, a significant number of drivers have red green color blindness which may impair their ability to distinguish between the conventional green light signal for "GO" and the conventional red light signal for "STOP". Thus, under poor lighting or poor weather conditions, a driver may fail to stop before an intersection when the traffic signal glows red and thereby endanger himself and others.

Besides traffic signals, the driver must continually monitor other visual information. Even under the worst weather conditions, e.g. snowstorms, duststorms, fog, etc., the driver must understand the position of the vehicle in relation to the road and other vehicles. If the driver fails to understand the edge of the road and the vehicle veers off the road, a serious collision may result. At minimum, the driver may not be able to return the vehicle to the road. In such weather, when vehicles ahead of the driver slow down, a delay in perceiving such condition could lead to a serious collision.

Much needed driver information presumes keen and watchful perception on the part of the driver. The driver has must watch for and perceive visual events that appear with only a moment's notice. Road hazards, such as potholes and debris, pose serious risks to vehicles. Animals in the roadway, whether still or live, cause damage to vehicles and may cause vehicles to veer off the road. Caution and warning signs must also be perceived in time to be heeded. If vehicles approach a sharp turn or lane merge too fast, they may collide or veer off the road.

For all these reasons, an on-board vehicle signaling system is needed which complements external visual driver information by receiving and indicating driving-related signals such as the phase of a traffic stoplight being approached by the vehicle.

SUMMARY OF THE INVENTION

Accordingly, the vehicle on-board system of the present invention is adapted to receive and indicate driving-related signals including phases of traffic light signals to a driver of the vehicle. The on-board system includes means for receiving a plurality of driving related signals, the signals including at least one signal representing a phase of a traffic light signal in proximity to the system; and means for indicating the driving-related signals to a driver.

Preferably, the receiving means includes means for distinguishing a plurality of distinct signals and may include polling means which activate signaling devices external to the system, and the signaling devices are adapted to produce the driving related signals. The indicating means is preferably adapted to indicate all phases of a traffic light signal. The indicating means is preferably further adapted to indicate one of the red, green and amber light signals of a traffic signal using at least one light selected from the group consisting of blue, orange, brown or purple. The indicating means may preferably be adapted to verbally indicate the phases of a traffic signal, through, for example, an indicator light which bears a label such as "STOP", "GO", or "CAUTION".

In addition to, or alternatively, the indicating means may be adapted to provide auditory indication of the phases of the traffic signal. By way of example, the auditory indication may include a voiced verbal message.

DETAILED DESCRIPTION OF THE PREFERRED EMBODIMENTS

Figure 1:
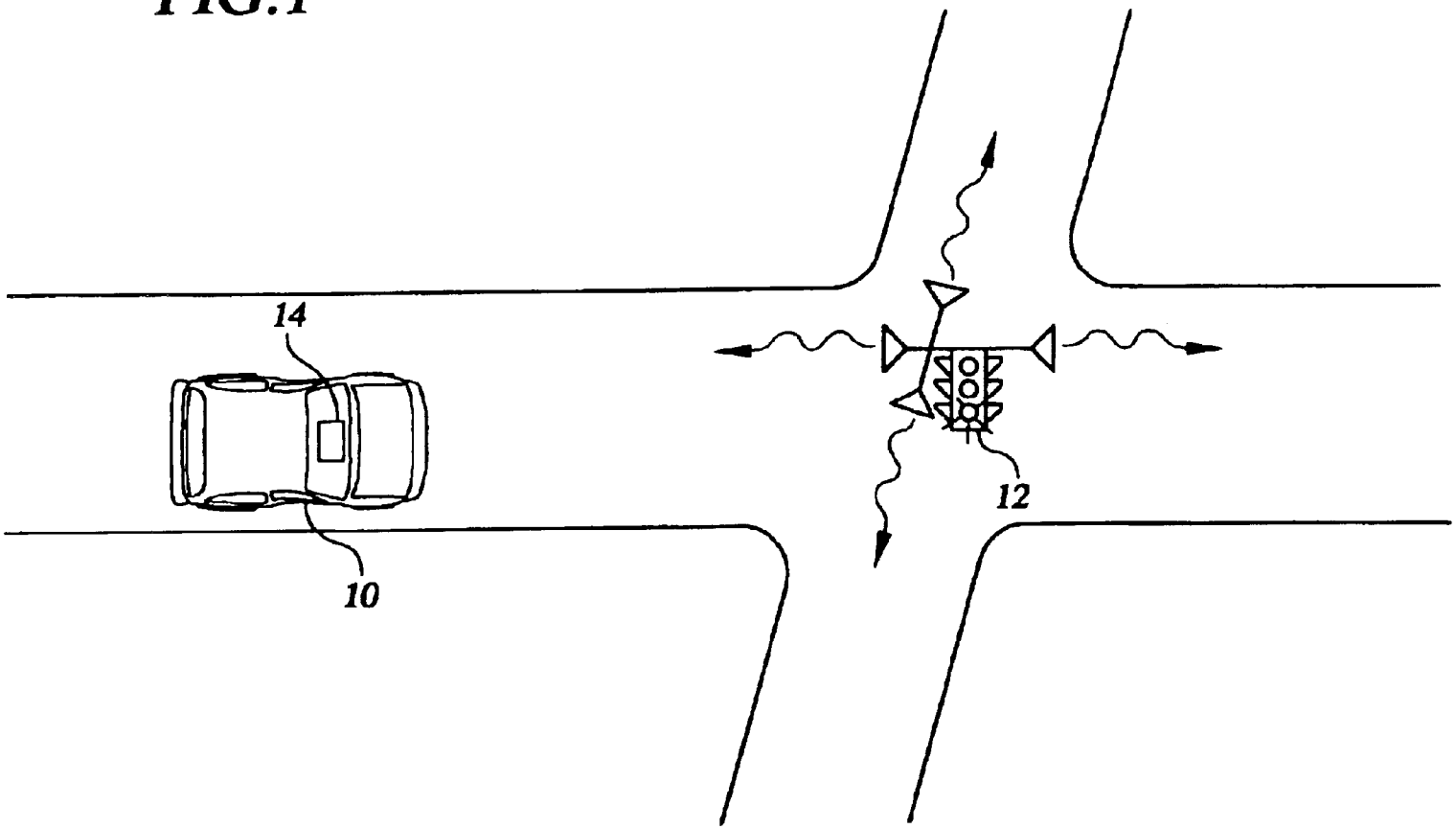
FIG. 1 illustrates a possible use of the on-board vehicle receiving and indicating system in connection with traffic light signaling.

FIG. 1 illustrates a possible use of an embodiment of the invention for receiving and indicating traffic light signals on board a vehicle 10 approaching a traffic signal 12. Distinguishable signals, for example radio frequency signals, are transmitted towards vehicles approaching the traffic signal 12 in connection with traffic light signals which are illuminated by traffic signal 12. A signal receiving and indicating system 14 on-board vehicle 10 receives the transmitted signals and indicates the signals to the driver of the vehicle.

Figure 2:
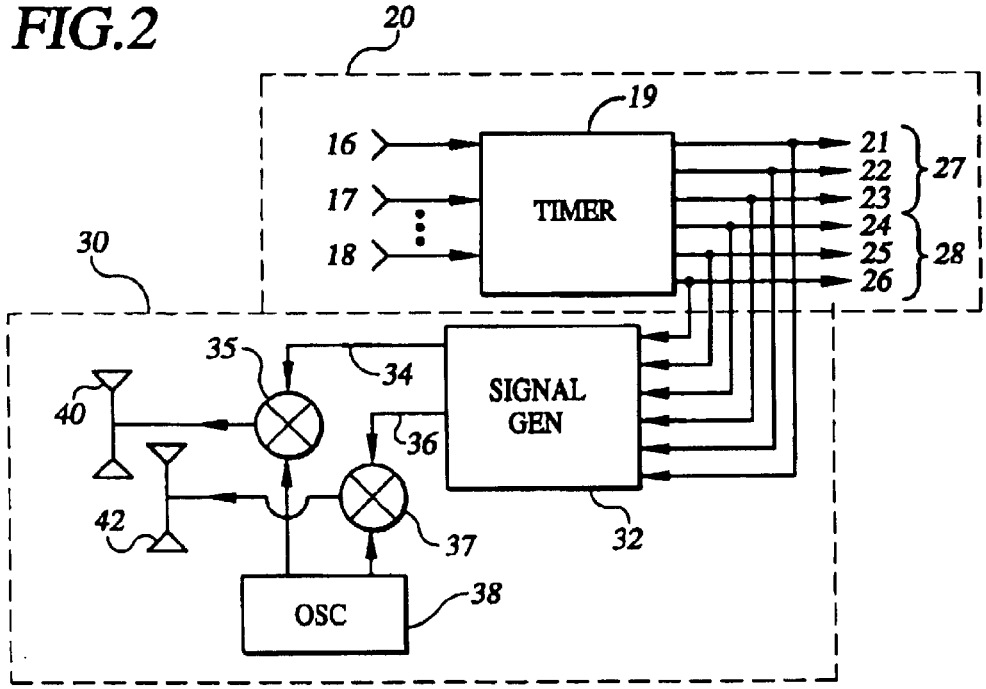
FIG. 2 is a block diagram illustrating circuitry for transmitting traffic light signals for reception by on-board vehicle receiving system.

The signal receiving aspect of the invention may be realized in a number of ways. In the example described as follows, radio frequency signals are transmitted in connection with the traffic light signals, the radio frequency signals being received by the on board vehicle receiver/indicator system 14. However, another way to transmit and receive signaling is through light, e.g. from narrowband sources, especially infrared LEDs and infrared lasers FIG. 2 illustrates a possible signal transmitter 30 implementation for transmitting signals indicating traffic light signal phase for reception by the on-board vehicle receiving system 14. As background to the invention, it will be understood, a traffic light signal controller 20 for a conventional red-amber-green traffic light signal outputs a group 27 of lamp controls 21, 22, and 23 for timing the illumination of red, amber, and green lights at the intersection from two directions in the line of one road, for example, east and west. At the same time, the signal controller 20 outputs a group 28 of lamp controls 24, 25, and 26 for timing the illumination of the red, amber and green lights in the other two directions, e.g. north and south, in the line of the intersecting road. As is known, the lamp controls 21 through 26 are generated by signal controller 20 through use of a timer 19, alone, or together with certain inputs 16 . . . 18, e.g. road vehicle sensors, and pushbutton input from pedestrians, etc. It will be understood that only one lamp control can be active at a time in a group 27 or 28 while the other two lamp controls are deactivated, such that only one lamp, e.g. the red lamp, is illuminated, while the green and amber lamps are turned off.

Lamp controls 21 through 26 are input to a signal generator 32 of signal transmitter 30. Signal generator 32 simultaneously generates at least two orthogonal signals 34, 36 for transmission to vehicles. One signal 34 modulates an RF carrier from oscillator 38 via mixer 35 for transmission over a first pair 40 of directional antennas, one directional antenna transmitting, for example, in the north direction of a road traversing the intersection, and the other directional antenna transmitting in the opposite direction of the road, i.e. south direction. Signal 36 modulates RF carrier from oscillator 38 via mixer 37 for transmission over a second pair 42 of directional antennas in the directions of a second road traversing the intersection. Each of signals 34 and 36 preferably change with the phase of the traffic signal 12 such that "STOP", "CAUTION" and "GO" signals are transmitted over respective pairs 40, 42 of directional antennas in phase with the red-amber-green light signals of traffic light signal 12.

The traffic signal phase information of a signal 34 or 36 must be reliably and unmistakably distinguished time after time with little chance of disruption from unintentional, internal or external sources of signal interference. Accordingly, signals 34, 36 may comprise different tones. Alternatively, signals 34, 36 may comprise pulse sequences of varying information content.

Figure 3:
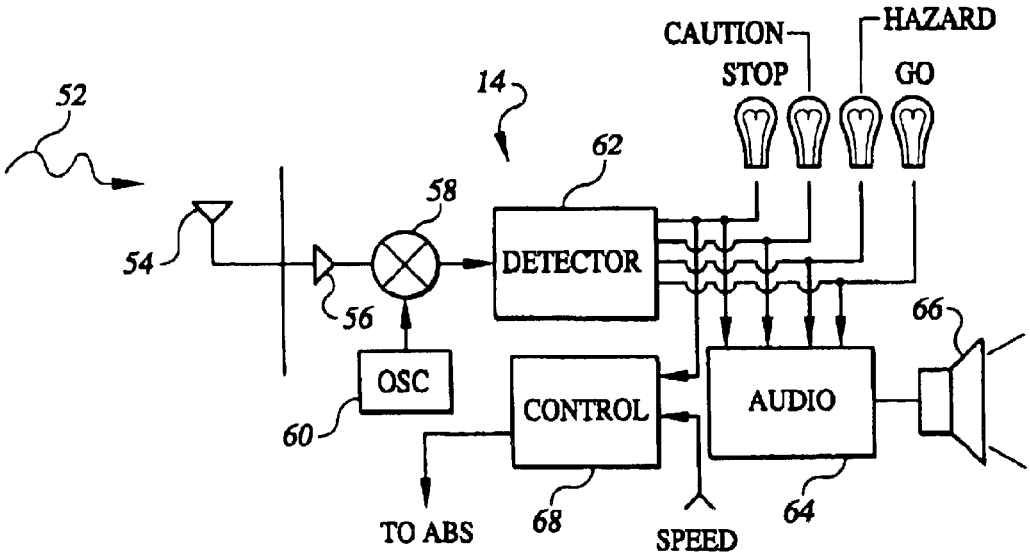
FIG. 3 is a block diagram illustrating an embodiment of on-board vehicle receiving and indicating system.

The signal receiving and indicating system 14 on-board a vehicle will now be described, with reference to FIG. 3. As shown in FIG. 3, transmitted signals 52 are picked up on an antenna 54, which may be the vehicle's existing radio antenna, the car's body, or a special antenna attached only to system 50. Signals from antenna 54, after being bandpass filtered, are provided to fixed gain amplifier 56 and then to mixer 58 for downconversion using RF frequency from oscillator 60. The downconverted signal is provided to detector 62 which discriminates the received signals and outputs them, to indicator lamps verbally labeled "STOP", "CAUTION", "HAZARD" and "GO". Only one of "STOP", "CAUTION" and "GO" lamps of system 14 will be illuminated at a particular time, according to the phase of traffic signal 12 in the direction the vehicle is traveling. For example, when the red signal light is illuminated at traffic signal 12, the corresponding RF signal is received from transmitting system 30 on board the vehicle system 14 and the indicator lamp of system 14 which is labeled "STOP" is illuminated. Similarly, when the amber light is illuminated at traffic signal 12, a different signal is transmitted from system 30 and received on board the vehicle by system 50, which then illuminates the indicator lamp labeled "CAUTION". When the green light is illuminated at traffic signal 12, yet another signal is received by on board vehicle system 50, and the indicator lamp of system 14 which is labeled "GO" is then illuminated. The "HAZARD" indicator lamp is in addition to the indicator signals which correspond to the red-amber-green traffic light signal. The "HAZARD" indicator lamp can be illuminated upon receipt of a signal indicating a nearby road hazard, stopped traffic condition, or reduced speed limit due to special circumstances, e.g. severe weather condition or school zone active period.

Preferably, the indicator lamps of system 14 are also color coded to further aid in the driver's immediate perception thereof. Since most drivers obtain best perception with a conventional color scheme, the "STOP" lamp is color-coded red, the "CAUTION" lamp is color-coded amber and the "GO" lamp is color-coded green. It will be understood that such color coding can be accomplished by installing colored lenses over incandescent lamps, or alternatively, using colored light emitting diodes directly.

However, a significant number of drivers suffer from red-green color blindness. For such drivers, it is often difficult to distinguish between the conventional red and green colors used on traffic light signals to indicate "STOP" and "GO". System 14 includes optional lamp settings or, alternatively, optional lenses that permit different choices of colors to help color-blind drivers best distinguish differences between the indicated signals. For example, the color blue can be used instead of green to indicate "GO." Other colors, for example, orange, brown or purple, may be used instead of one or more of the conventional traffic signal light colors, to help ensure best perception.

Receiving and indicating system 14 preferably includes an audio control unit 64 responsive to the separated signal output of detector 62 and loudspeaker 66 for providing auditory indications to the driver. Auditory indications can be nonverbal signals such as beeps, hums, etc. or voiced verbal messages that simulates or plays back human voice commands. For example, when approaching a traffic signal 12 that is glowing red, the audio control unit 64 will output a voiced verbal message of "STOP" over the loudspeaker 64. Similarly, when the traffic signal 12 is glowing green, a voiced verbal message of "GO" is output.

In addition to the above functions, the receiving system 14 may also have a collision avoidance feature which automatically stops the vehicle when approaching the traffic signal that is glowing red (signaling "STOP") at an excessive speed. The collision avoidance feature is implemented by a collision avoidance (CA) control unit 68 which receives "STOP" indicator input from detector 62 and an input from the vehicle representing its speed. Output from control unit 68 is provided to the vehicle's antilock braking system (ABS). A typical antilock braking system electronically varies the hydraulic pressure at the brake wheel cylinders many times a second to avoid wheel lock-up. However, a vehicle's ABS is typically only engaged by a fully depressed brake pedal, and once engaged, braking proceeds very rapidly, such that unsecured objects in the vehicle may be thrown forward. The CA feature of the invention contemplates use in connection with an ABS that can be engaged electronically, i.e. without requiring the brake pedal to be depressed, or fully depressed. Such ABS may also provide a second gradual stopping mode, for use when vehicle speed is only somewhat over limit. In such gradual mode, the ABS cycles the hydraulic pressure to a reduced pressure which is below the maximum pressure used for making sudden stops.

What is claimed is:

1. A system for use on board a vehicle for receiving driving related signals, including at least the red light phase of a traffic light, said system comprising:

a receiver operable to receive a plurality of driving-related signal including at least one transmitted signal representing the red light phase of a traffic light signal used to signal traffic along a roadway in proximity to the vehicle; and a collision avoidance (CA) controller operable to electronically engage an antilock braking system (ABS) of the vehicle, said CA controller responsive to output of said receiver and to a speed of the vehicle to cause the ABS to automatically slow the vehicle to a stop when the vehicle approaches the traffic light signal during the red light phase thereof at excessive speed.

2. The system of claim 1 wherein said receiver is operable to distinguish a plurality of distinct signals.

3. The system of claim 1 further comprising polling means for activating signaling devices external to said system, said signaling devices adapted to produce said driving related signals.

4. The system of claim 1 wherein said system includes a plurality of signal indicators responsive to output of receiver, said plurality of signal indicators being operable to indicate all phases of the traffic light signal.

5. The system of claim 4 wherein said plurality of signal indicators is operable to verbally indicate said phases.

6. The system of claim 5 wherein said plurality of signal indicators includes an indicator light bearing a label, said label selected from the group consisting of "STOP", "GO" and "CAUTION".

7. The system of claim 5 wherein said plurality of signal indicators is operable to provide auditory indication said phases.

8. The system of claim 7 wherein said auditory indication includes a voiced verbal message.

9. The system of claim 1, wherein said CA controller is operable to cause the ABS to stop the vehicle gradually upon determination that the vehicle speed is only somewhat over limit.

10. The system of claim 1, further comprising one or more signal indicators responsive to output of said receiver to indicate the driving related signals to a driver of the vehicle.

11. A system for use on board a vehicle for receiving and indicating driving related signals, including phases of traffic light signals, said system comprising:

a receiver operable to receive a plurality of driving-related signals including signals representing phases of a traffic light signal used to signal traffic a roadway in proximity to the vehicle; and a plurality of signal indicators responsive to output of said receiver to indicate said signals to a driver of the vehicle, wherein the traffic light signal indicates the phases using red, green and amber lights, and said plurality of signal indicators is operable to indicate said phases using at least one light having a color selected from the group consisting of blue, orange, brown or purple.

12. A system for use on board a vehicle for receiving and indicating driving related signals, including phases of traffic light signals, to a driver of the vehicle, said system comprising:

a receiver operable to receive a plurality of driving-related signals including a plurality of signals transmitted wirelessly by transmitting devices located outside of and in proximity to the vehicle, the driving related signals including at least one signal representing a phase of a traffic light signal used to signal traffic along a roadway, and at least one signal representing a condition occurring in proximity to vehicle, the condition selected from the group consisting of a road hazard, reduced speed limit, active period for school zone, and stopped traffic; and a plurality of signal indicators responsive to output of said receiver to indicate said signals to a driver of the vehicle.

13. The system of claim 12, further comprising polling means, the polling means operable to activate at least some of the transmitting devices to at least some of the plurality of driving related signals.

* * * * *